US009763503B2

(12) United States Patent
Selvi

(10) Patent No.: US 9,763,503 B2
(45) Date of Patent: Sep. 19, 2017

(54) SIDE BOUND SPLIT TROLLEY CASE

(71) Applicant: IT LUGGAGE LIMITED, Harlow, Essex (GB)

(72) Inventor: Sedat Selvi, London (GB)

(73) Assignee: IT Luggage Limited (GB)

( * ) Notice: Subject to any disclaimer, the term of this patent is extended or adjusted under 35 U.S.C. 154(b) by 0 days.

(21) Appl. No.: 14/898,414

(22) PCT Filed: Jun. 12, 2014

(86) PCT No.: PCT/GB2014/051811

§ 371 (c)(1),
(2) Date: Dec. 14, 2015

(87) PCT Pub. No.: WO2014/199165

PCT Pub. Date: Dec. 18, 2014

(65) Prior Publication Data

US 2016/0135558 A1 May 19, 2016

(30) Foreign Application Priority Data

Jun. 12, 2013 (GB) ..... 1310446.8

(51) Int. Cl.
*A45C 13/04* (2006.01)
*A45C 5/14* (2006.01)
(Continued)

(52) U.S. Cl.
CPC ..... *A45C 5/14* (2013.01); *A45C 5/02* (2013.01); *A45C 13/04* (2013.01); *A45C 13/262* (2013.01);
(Continued)

(58) Field of Classification Search
CPC ..... A45C 13/262; A45C 5/14; A45C 13/04
(Continued)

(56) References Cited

U.S. PATENT DOCUMENTS 2,536,169 A * 1/1951 Gray ..... A45C 3/00 190/103
3,443,671 A * 5/1969 Dyke ..... A45C 7/0027 190/103
(Continued)

FOREIGN PATENT DOCUMENTS

WO 2013072086 5/2013

OTHER PUBLICATIONS

PCT International Search Report, International Application No. PCT/GB2014/051811, Sep. 25, 2014, 4 pages.

*Primary Examiner* — Sue A Weaver
(74) *Attorney, Agent, or Firm* — Barnes & Thornburg LLP

(57) ABSTRACT

Generally suitcases, or other articles of luggage, can be divided into 'hard' and 'soft' constructions. Both kinds of cases have their advantages, but each has its own disadvantages. An article of luggage is disclosed comprising a first portion and a second portion connected by a hinge arrangement, each of the first and second portions including a lower structural assembly (6,10) comprising a shell and an upper structural assembly (8,12) comprising a framework provided with a covering (50), the lower structural assembly and the upper structural assembly being secured together by stitching. Such an article of luggage has as an advantage that the lower structural assembly (6,10) provides stability for wheel fixings (30) and for location of a retractable towing handle assembly (74), while the upper structural assembly provides for a light-weight construction.

12 Claims, 4 Drawing Sheets

(51) Int. Cl.
*A45C 5/02* (2006.01)
*A45C 13/26* (2006.01)
*A45C 5/03* (2006.01)

(52) U.S. Cl.
CPC .. *A45C 2005/035* (2013.01); *A45C 2013/267* (2013.01)

(58) Field of Classification Search
USPC ..... 190/18 A, 39, 100, 115, 24, 103, 122
See application file for complete search history.

(56) References Cited

U.S. PATENT DOCUMENTS

| | | | | | |
|---|---|---|---|---|---|
| 5,056,695 | A * | 10/1991 | Giblet | B60R 9/065 | 190/18 A |
| 5,685,402 | A * | 11/1997 | Lin | A45C 13/262 | 190/115 |
| 7,641,030 | B2 * | 1/2010 | Selvi | A45C 5/03 | 190/103 |
| 8,662,268 | B2 * | 3/2014 | Keir | A45C 5/14 | 190/115 |
| 2002/0185350 | A1 * | 12/2002 | Chang | A45C 5/02 | 190/105 |
| 2007/0209894 | A1 * | 9/2007 | Selvi | A45C 3/001 | 190/100 |
| 2011/0168506 | A1 * | 7/2011 | Santy | A45C 3/001 | 190/125 |

* cited by examiner

SIDE BOUND SPLIT TROLLEY CASE

CROSS-REFERENCE TO RELATED APPLICATIONS

This application is a national stage entry under 35 USC §371(b) of PCT International Application No. PCT/GB2014/051811, filed Jun. 12, 2014, and claims the benefit of United Kingdom Patent Application No. 1310446.8, filed on Jun. 12, 2013, both of which are expressly incorporated by reference herein.

BACKGROUND

The present invention relates to an improved article of luggage for use by travellers, and a method of manufacture of such a case.

Generally suitcases, or other articles of luggage, can be divided into 'hard' and 'soft' constructions. Broadly, hard cases are those in which the top, bottom and sides cannot be pierced by a blade or needle (or at least to substantially resist this) and those that are not of 'hard' construction are considered to be of 'soft' construction.

SUMMARY

Both kinds of cases have their advantages, but each has its own disadvantages. For example while hard cases are resistant to piercing, is this comes at the expense of the weight of the overall case. Similarly while soft cases often have weight advantages, other problems remain.

It is an advantage of the present invention that an article of luggage is provided having some advantages of each form of construction.

According to a first aspect of the present invention, an article of luggage comprises a first portion and a second portion connected by a hinge arrangement, each of the first and second portions including a lower structural assembly comprising a shell and an upper structural assembly comprising a framework provided with a covering, the lower structural assembly and the upper structural assembly being secured together by stitching.

Such an article of luggage has as an advantage that the lower structural assembly provides stability for wheel fixings and for location of a retractable towing handle assembly, while the upper structural assembly provides for a lightweight construction.

Preferably, the framework comprises a plurality of elements, one or more of the elements being secured to the shell of the lower structural assembly by stitching.

Preferably, the covering is secured to an upper region of the shell by stitching.

Preferably each shell is formed as a unitary moulding.

Preferably, the article of luggage further comprises a plurality of wheel assemblies, each wheel assembly being secured to the lower structural assembly of one of the first and second portions.

Preferably, the article of luggage further comprises a towing handle assembly comprising a base part secured to the lower structural assembly of one of the first and second portions.

Preferably the covering of the framework of one of the first and second portions is provided with further storage volumes.

According to a second aspect of the present invention, a method of constructing an article of luggage comprising first and second portions connected by a hinge arrangement, comprises the steps of providing first and second lower structural assemblies comprising moulded shells and first and second upper structural assemblies comprising a covered framework, connecting a first lower structural assembly and a first upper structural assembly by stitching to form a first portion, connecting a second lower structural assembly and a second upper structural assembly by stitching to form a second portion, and providing a hinge arrangement between the first portion and the second portion.

Preferably the framework is provided as a plurality of elements, one or more of the elements being secured to the shell by stitching.

Preferably, the hinge arrangement is provided in the form of a zip fastener arrangement.

Preferably, the method further comprises providing a plurality of wheel assemblies, each wheel assembly being secured to the lower structural assembly of one of the first and second portions.

Preferably, the article of luggage further comprises providing a towing handle assembly comprising a base part, the base part being secured to the lower structural assembly of one of the first and second portions.

BRIEF DESCRIPTION OF THE DRAWINGS

The invention will now be described, by way of example only, in relation to the attached Figures, in which.

DETAILED DESCRIPTION

Figure 1:
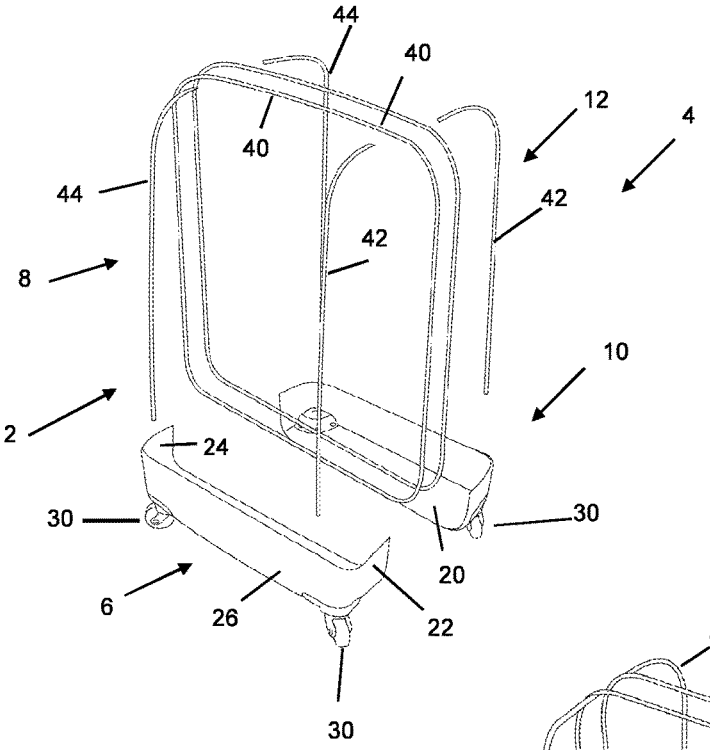
FIG. 1 shows an exploded view of elements making up a first embodiment of an article of luggage in accordance with the present invention.
Figure 2:
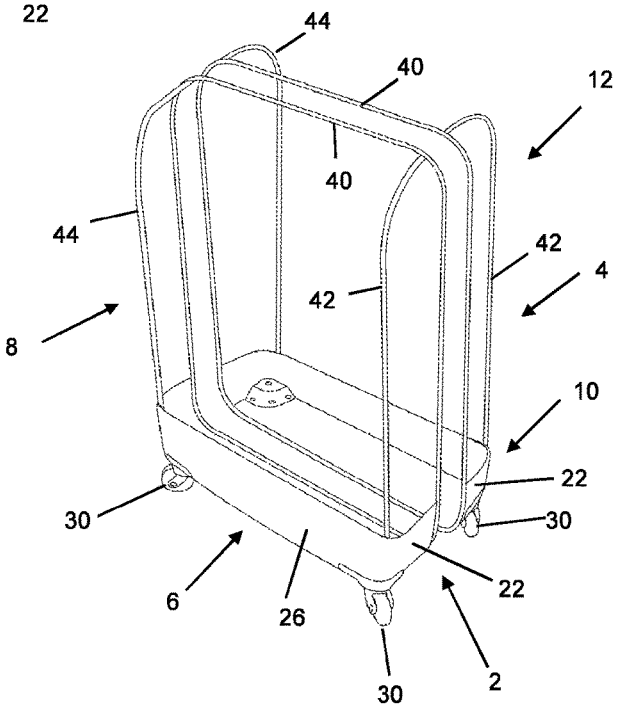
FIG. 2 shows an assembled view of the elements of FIG. 1.

Referring first to FIGS. 1 and 2 there is shown an exploded view of elements making up an article of luggage 4 in accordance with the present invention. The article of luggage 4 comprises a first portion and a second portion, each of the first and second portions including a lower structural assembly 6,10 comprising a shell and an upper structural assembly 8,12 comprising a covered framework. The covering of the framework is omitted from FIGS. 1 and 2 for clarity.

In practice, it will be seen that in the illustrated embodiment, the first and second portions are of similar construction. As such only one will be described, with the other being taken as similar unless otherwise stated.

Each lower structural assembly 6,10 of the first portion comprises a shell defining a base 20 having a first end and a second end, end walls 20,22 extending upwards from the first and second ends of the base 20 and a connecting wall 24 joining an edge of the base 20 to each of the end walls 20,22. Each shell is preferably formed as a unitary moulding. Each shell is preferably formed from a polymeric material such as EVA (Ethylene Vinyl Acetate) or ABS (Acrylonitrile Butadiene Styrene).

Corners are defined where the base 20 and connecting wall 26 join to an end wall 22,24. Each of the corners provide a stable location for the location of wheel assemblies 30 or foot assemblies as may be required. Each corner may further be provided with a shaped indentation to receive an upper end of a wheel assembly or the like. In the illustrated embodiment each recess comprises an upper surface 28 (FIG. 3) between the connecting wall 26 and an end wall 22,24, the upper surface 28 being disposed in a plane parallel, or substantially so, to the base 20 of the shell with a depending wall 29 connecting the upper surface 28 to the connecting wall 26, the base 20 and the respective end wall 22,24. Such shaped indentations provide further stability to the wheel assemblies or the like secured thereto.

Each upper structural assembly 8,12 comprises a framework. The framework conveniently comprises three elements. A first rectangular element 40 corresponds to the intended section of the article of luggage, the dimensions of the rectangular element 40 being such its lower end matches the shell of the lower structural assembly as will be explained further below. The second and third elements 42,44 are generally L-shaped, the shorter limb defining a depth of the portion and the longer limb depending therefrom. A free end of each shorter limb is in use connected by any suitable means to an upper part of the rectangular element 40. In the illustrated embodiment, a lack of interconnecting means may be noted. Preferably, each of the second and third elements 42,44 is connected or held in relation to the upper part of the rectangular element 40 spaced one from the other at opposing ends of the first rectangular element 40.

Conveniently the elements 40,42,44 of the framework comprise shaped wires.

In use the elements of the framework are provided with a suitable covering 50. The covering 50 is preferably of a suitable cloth, for example a woven cloth such as polyester. Conveniently the covering 50 is secured to the elements of the framework in any convenient manner, for example the covering 50 is stitched to or about the elements of the framework. It is an advantage of such a construction that no foamed materials or moulded materials (such as interconnecting pieces) are required to define the structure of the upper structural assembly, and since such materials weigh more than the cloth covering, such a construction contributes to the overall lightness of an article of luggage according to the present invention. It is an advantage that stitching of the elements of the framework into the covering serves to hold the elements of the framework in relation to one another and the need for separate securing means is removed.

As may be seen with particular reference to FIG. 2, the free ends of the depending longer limbs of the second and third elements 42,44 are connected to an upper part of the shell in the region where the connecting wall 26 joins the respective end walls 22,24 and the lower end of the rectangular element 40 fits to and is joined with free edges of the side walls 22,24 and a free edge of the base 20.

Conveniently the free ends of the depending longer limbs of the second and third elements 42,44 are connected to the upper part of the shell by stitching.

The covering 50 of the upper structural assembly 8,12 is connected at a lower region to an upper region of the shell of the lower structural assembly 6,10 by any suitable means, for example by stitching.

A zip fastening arrangement 60 is connected to the rectangular element 40. (In FIG. 3, while the covering 50 and a portion of the zip fastening arrangement 60 are shown, a lower part of the rectangular element 40 and the zip fastener arrangement 60 are omitted for clarity).

Typically the zip fastening arrangement 60 comprises a left hand hem or webbing and a right hand hem or webbing 62,64 connected by releasable interlocking teeth. The webbing 62,64 at each side is connected to one of the first and second portions to or about the rectangular element 40 of the upper structural assembly 8,12 to provide a hinge arrangement connecting the first and second portions. In this way it will be understood that each rectangular element 40 may be held in a respective hem of the zip fastening arrangement 60 itself secured in the region of the lower structural assembly 6,10 to the shell of the lower structural assembly 6,10, and so that the rectangular element 40 is in this way joined with the free edges of the side walls 22,24 and a free edge of the base 20 of the shell.

Other zip fastening arrangements such as an expander may also be utilised.

While the first and second portions have been illustrated as having similar dimensions, it will be appreciated that other arrangements are possible. For example, alternatively one of the portions may substantially define an internal volume of the article of luggage with the other portion acting as a lid to close the volume.

Figure 3:
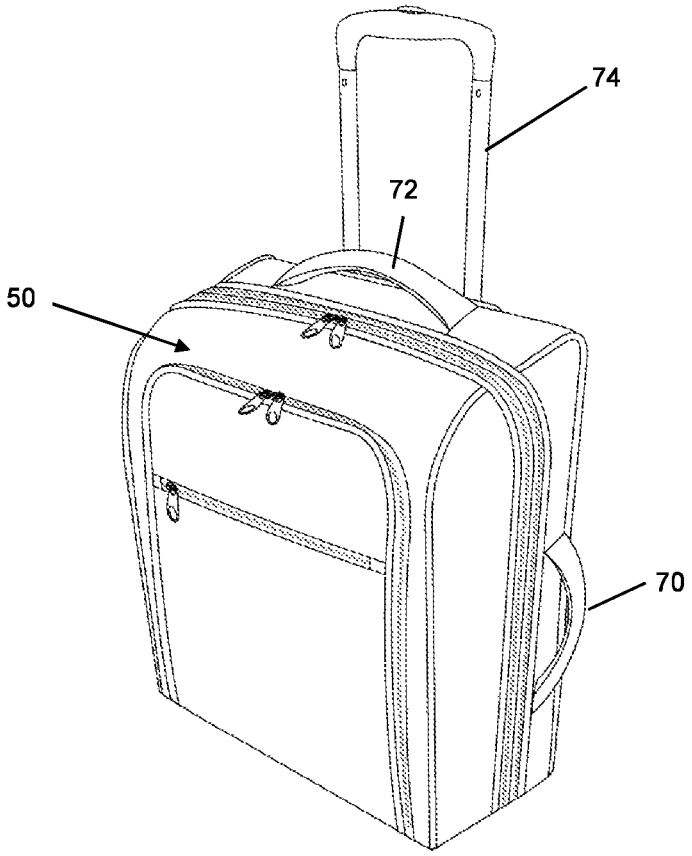
FIG. 3 shows a somewhat schematic view showing the upper and lower structural assemblies of the present invention.
Figure 3:
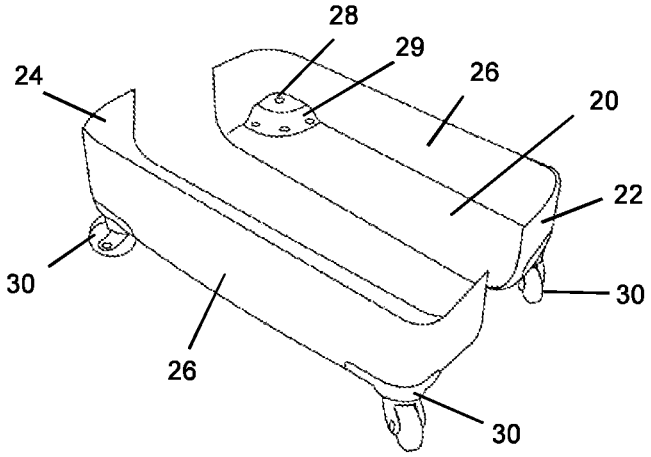
Figure 4:
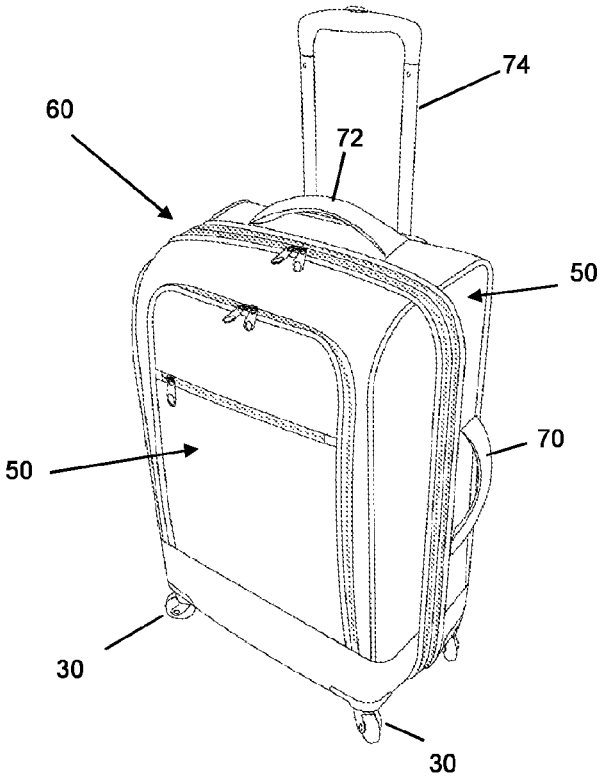
FIG. 4 shows a perspective view of an article of luggage in accordance with the present invention in a first closed configuration.
Figure 5:
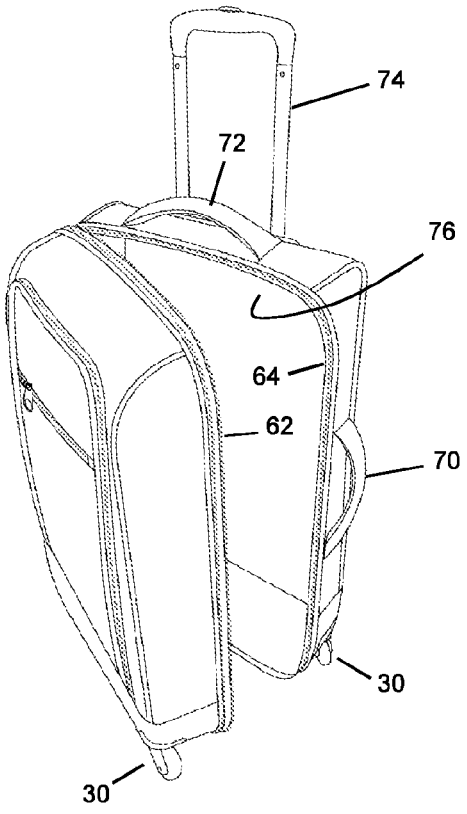
FIG. 5 shows a perspective view of an article of luggage in accordance with the present invention in a second partially open configuration.
Figure 6:
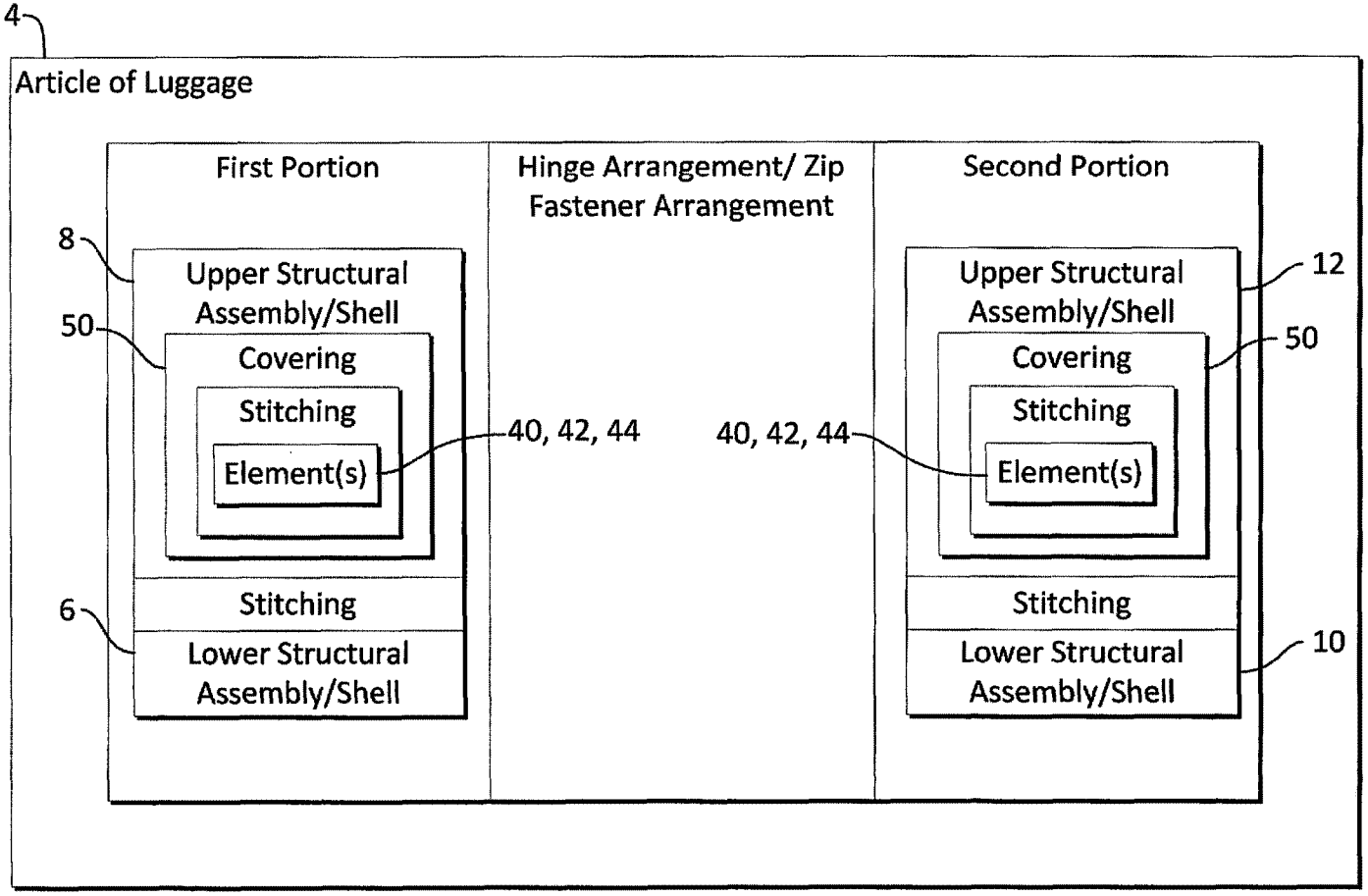
FIG. 6 shows a diagrammatic view of an article of luggage having a hinge arrangement and stitching.

As shown in relation to FIGS. 3, 4 and 5 further storage volume(s) can be provided on the covering 50 forming a front face of the article of luggage. The covering 50 may also be used may be used to secure a side handle 70 and/or a top handle 72 to the article of luggage.

A towing handle 74 having a base part comprising receiving tubes and an adjustable extendable part comprising an handle with depending tubular members adapted to be telescopically received within the receiving tubes can be provided. In particular, a base of a towing handle assembly 74 can be secured in any suitable manner to the base 20 of the shell of the lower structural assembly of the portion forming the rear of the article of luggage. The covering 50 is provided with openings at which upper ends of the receiving tubes of the towing handle assembly 74 are located. In FIG. 5, it can be seen that a further covering 76 has been provided within the rear portion about the towing handle assembly 74 to prevent items transported within the article of luggage from being caught up on, snared upon or otherwise entangled with the towing handle assembly 74. The further covering 76 may take any suitable form for example a board, preferably a polypropylene board of suitable size. Alternatively, the further covering 76 may be a flexible lining material, for example of polyester or nylon.

What is claimed is:

1. An article of luggage comprising a first portion and a second portion connected by a hinge arrangement, each of the first and second portions including a lower structural assembly comprising a shell and an upper structural assembly lacking any moulded materials and comprising a cloth-covered framework of frame elements that are connected together, the lower structural assembly and the upper structural assembly being secured together by stitching.

2. An article of luggage according to claim 1, in which the framework comprises a plurality of elements, one or more of the elements being secured to the shell of the lower structural assembly by stitching.

3. An article of luggage according to claim 1, in which a covering of the cloth-covered framework is secured to an upper region of the shell by stitching.

4. An article of luggage according of claim 1, in which each shell is formed as a unitary moulding.

5. An article of luggage according to claim 1, in which the article of luggage further comprises a plurality of wheel assemblies, each wheel assembly being secured to the lower structural assembly of one of the first and second portions.

6. An article of luggage according to claim 1, in which the article of luggage further comprises a towing handle assembly comprising a base part secured to the lower structural assembly of one of the first and second portions.

7. An article of luggage according to claim 1, in which a covering of the cloth-covered framework of one of the first and second portions is provided with further storage volumes.

8. A method of constructing an article of luggage comprising a first portion and a second portion connected by a hinge arrangement, comprises the steps of providing first and second lower structural assemblies comprising moulded shells and first and second upper structural assemblies lacking any moulded materials and comprising a cloth-covered framework of frame elements that are connected together, connecting a first lower structural assembly and a first upper structural assembly by stitching to form a first portion, connecting a second lower structural assembly and a second upper structural assembly by stitching to form a second portion, and providing a hinge arrangement between the first portion and the second portion.

9. A method according to claim 8, in which one or more of the frame elements being secured to the shell by stitching.

10. A method according to claim 8, in which the hinge arrangement is provided in the form of a zip fastener arrangement.

11. A method according to claim 8, in which the method further comprises providing a plurality of wheel assemblies, each wheel assembly being secured to the lower structural assembly of one of the first and second portions.

12. A method according to claim 8, in which the article of luggage further comprises providing a towing handle assembly comprising a base part, the base part being secured to the lower structural assembly of one of the first and second portions.

* * * * *